US010752013B2

(12) United States Patent
Shi et al.

(10) Patent No.: US 10,752,013 B2
(45) Date of Patent: Aug. 25, 2020

(54) ASSEMBLED NOTE-ISSUING DEVICE AND SELF-SERVICE FINANCIAL APPARATUS EQUIPPED THEREWITH

(71) Applicant: GRG BANKING EQUIPMENT CO., LTD., Guangzhou, Guangdong (CN)

(72) Inventors: Guocheng Shi, Guangdong (CN); Hexiang Huang, Guangdong (CN); Changhai Wu, Guangdong (CN); Changan Cen, Guangdong (CN); Dong Wei, Guangdong (CN)

(73) Assignee: GRG BANKING EQUIPMENT CO., LTD., Guangzhou (CN)

( * ) Notice: Subject to any disclaimer, the term of this patent is extended or adjusted under 35 U.S.C. 154(b) by 0 days.

(21) Appl. No.: 16/094,468

(22) PCT Filed: Apr. 1, 2017

(86) PCT No.: PCT/CN2017/079333
§ 371 (c)(1),
(2) Date: Oct. 18, 2018

(87) PCT Pub. No.: WO2017/181841
PCT Pub. Date: Oct. 26, 2017

(65) Prior Publication Data

US 2019/0130691 A1 May 2, 2019

(30) Foreign Application Priority Data

Apr. 19, 2016 (CN) ..... 2016 1 0243986

(51) Int. Cl.
*B65H 3/54* (2006.01)
*B41J 2/325* (2006.01)
(Continued)

(52) U.S. Cl.
CPC ..... *B41J 2/325* (2013.01); *B65H 1/14* (2013.01); *B65H 1/266* (2013.01); *B65H 3/0684* (2013.01);
(Continued)

(58) Field of Classification Search
CPC ..... G07D 11/13; G07D 11/14; G07D 11/10; G07D 11/235; B65H 3/0684; B65H 1/14; B65H 31/22; B65H 1/266
See application file for complete search history.

(56) References Cited

U.S. PATENT DOCUMENTS 4,320,854 A * 3/1982 Hirose ..... G07F 19/20 221/12
4,997,176 A * 3/1991 Hain ..... B65H 29/14 271/180
(Continued)

FOREIGN PATENT DOCUMENTS

CN 1923522 A 3/2007
CN 103264584 A * 8/2013
(Continued)

OTHER PUBLICATIONS

International Search Report of PCT Patent Application No. PCT/CN2017/079333 dated Jun. 29, 2017.

*Primary Examiner* — Patrick H Mackey

(57) ABSTRACT

The present invention discloses an assembled note-issuing device (100) and a self-service financial apparatus equipped therewith, comprising a base (10), a note container (20), a paper delivery assembly (30), a printing assembly (40) and a temporary storage assembly (50) that are arranged on the base (10) successively. The paper delivery assembly (30), the printing assembly (40) and the temporary storage assembly (50) are interconnected with the note container (20) through a note channel (60); the paper delivery assembly (30) delivers the notes in the note container (20) to the
(Continued)

printing assembly (40) through the note channel (60) for printing, and the printing assembly (40) transfers the printed notes to the temporary storage assembly (50) for temporary storage.

16 Claims, 16 Drawing Sheets

(51) Int. Cl.

| | |
|---|---|
| ***B65H 1/26*** | (2006.01) |
| ***G07D 11/10*** | (2019.01) |
| ***B65H 31/22*** | (2006.01) |
| ***B65H 1/14*** | (2006.01) |
| ***B65H 3/06*** | (2006.01) |
| ***G07D 11/14*** | (2019.01) |
| ***G07D 11/13*** | (2019.01) |
| ***G07D 11/235*** | (2019.01) |

(52) U.S. Cl.

CPC ..... *B65H 3/54* (2013.01); *B65H 31/22* (2013.01); *G07D 11/10* (2019.01); *G07D 11/13* (2019.01); *G07D 11/14* (2019.01); *G07D 11/235* (2019.01); *B65H 2301/4212* (2013.01); *B65H 2402/45* (2013.01); *B65H 2403/41* (2013.01); *B65H 2405/11152* (2013.01); *B65H 2405/121* (2013.01); *B65H 2405/313* (2013.01); *B65H 2553/42* (2013.01); *B65H 2601/321* (2013.01); *B65H 2601/325* (2013.01); *B65H 2701/1912* (2013.01); *G07D 2211/00* (2013.01)

(56) References Cited

U.S. PATENT DOCUMENTS

| | | | | |
|---|---|---|---|---|
| 5,335,901 | A * | 8/1994 | Nonomura | B65H 1/12 271/117 |
| 7,793,831 | B2 * | 9/2010 | Beskitt | G07F 19/20 235/379 |
| 7,971,781 | B2 * | 7/2011 | Ma | G07F 19/20 235/379 |
| 8,109,509 | B2 * | 2/2012 | Nireki | B65H 29/46 271/264 |
| 8,225,989 | B1 * | 7/2012 | Turocy | G07F 19/20 235/379 |
| 8,684,152 | B2 * | 4/2014 | Angus | G07D 11/14 194/206 |
| 2014/0300909 | A1 * | 10/2014 | Robinson | G07F 17/42 358/1.6 |

FOREIGN PATENT DOCUMENTS

| | | | |
|---|---|---|---|
| CN | 103264584 | A | 8/2013 |
| CN | 105160751 | A | 12/2015 |
| CN | 205044326 | U | 2/2016 |
| CN | 205386992 | U | 7/2016 |

* cited by examiner

ASSEMBLED NOTE-ISSUING DEVICE AND SELF-SERVICE FINANCIAL APPARATUS EQUIPPED THEREWITH

FIELD OF THE INVENTION

The present invention relates to the technical field of bank self-service apparatus, in particular, to an assembled note-issuing device and a self-service financial apparatus equipped therewith.

BACKGROUND OF THE INVENTION

With the development of financial self-service business, transformation has been a development trend in equipping bank branches. Wherein the extension of self-service channels allows banks to transfer some low value-added business to the self-service channels so that time of both banks and customers can be saved and thereby the efficiency can be enhanced.

Currently, bank notes (such as checks) are mostly issued from the bank counters, each customer needs to be assigned with an order number firstly and then he/she must wait in the bank until the number is called by a bank teller. When there are a lot of people in front of him/her, the waiting time may be very long. Thus, it is a waste of time for both bank staff and customers and it creates many difficulties for the promotion of working efficiency of bank staff.

SUMMARY OF THE INVENTION

Because of those problems existing in prior art, the present invention aims to provide an assembled note-issuing device and a self-service financial apparatus equipped therewith.

In order to realize the above mentioned aim, embodiments of the present invention provide following technical solutions:

the present invention provides an assembled note-issuing device, comprising a base, a note container, a paper delivery assembly, a printing assembly and a temporary storage assembly that are arranged on the base successively. The note container reserves notes and is configured with a note channel for interconnecting with the paper delivery assembly, the printing assembly and the temporary storage assembly. The paper delivery assembly delivers the notes in the note container to the printing assembly through the note channel for printing, and the printing assembly transfers the printed notes to the temporary storage assembly through the note channel for temporary storage.

Preferably, the temporary storage assembly comprises a casing, a gate, a top lid and a locking assembly, wherein the casing comprises a receiving room with an opening, the gate is pivotally coupled to the casing so as to close the opening of the casing, the top lid is secured to the casing, the locking assembly comprises an unlocking handle, a link rod, an electromagnetic valve and a latch, a sliding groove is configured on the top lid, the unlocking handle is slidably coupled in the sliding groove and one end of the unlocking handle protrudes through the sliding groove, the electromagnetic valve is fixed in the casing, the unlocking handle is coupled to the electromagnetic valve via the link rod, the latch located in the casing comprises an abut end and a rotary end, the rotary end is pivotally coupled with the unlocking handle and the abut end is configured to face the gate;

when the unlocking handle is stirred to slide to and abut against a first end of the sliding groove, the latch shaft drives the latch to rotate so that the abut end goes away from the gate, and then the gate is unlocked;

when the unlocking handle is stirred to slide to and abut against a second end of the sliding groove, the latch shaft drives the latch to rotate so that the abut end gets close to the gate and renders it close.

Further, the temporary storage assembly also comprises an elastic member and the casing is configured with a projection at the position adjacent to the gate, the two ends of the elastic member are respectively coupled with the unlocking handle and the projection so as to provide restoring force for restoration of the unlocking handle.

Preferably, the note container includes a first housing with an opening, a tray for placing notes, a first lid pivotally attached to the first housing and a lifting device.

The first housing is arranged on the base and the note channel is arranged on the tray, a pressing plate is configured in the first lid, the first lid closes the opening of the first housing so that the pressing plate abuts against the notes on the tray; the lifting device is coupled to the tray in order to drive the tray to move up and down vertically.

Further, the lifting device includes a first motor, a first gear cluster and a rack, the first motor is arranged on the first housing, the first gear of the first gear cluster is coupled to the output shaft of the first motor, the rack is engaged with the last gear of the first gear cluster, and the tray is attached to one end of the rack; the first motor drives the first gear cluster to rotate so that the tray is driven to move up and down vertically by the rack.

Preferably, the paper delivery assembly comprises a second housing and a second lid pivotally coupled to the second housing, a first driving mechanism and a paper picking wheel arranged in the second housing; the first driving mechanism is arranged at one end of the tray, the paper picking wheel is configured above the tray, the first driving mechanism comprises a second motor and a second gear cluster, the first gear of the second gear cluster is attached to the output shaft of the second motor, a shaft is arranged through the paper picking wheel, the shaft is attached to the last gear of the second gear cluster, the second motor drives the second gear cluster to rotate and consequently drives the paper picking wheel to rotate around the shaft.

Further, the paper delivery assembly also comprises a casing a sensing assembly, the paper picking wheel is located in the casing, the casing has an outer end surface, the sensing assembly comprises a sensor support, a first sensor and a baffle; the first sensor is secured to the sensor support, the sensor support is configured with a slot for the baffle to insert and one end of the baffle is secured to the outer surface of the casing;

when the tray moves upward vertically until the notes thereon contact with the paper picking wheel, the notes abut against the paper picking wheel and thereby the paper picking assembly drives the baffle to move into the slot of the sensor support, meanwhile, the second motor actuates the paper picking wheels to pick up papers;

when the notes on the tray lessens, the notes separate with the paper picking wheel and the separation therebetween leads the baffle to leave the slot of the sensor support; at that time, the first motor drives the tray to move upward until the notes on the tray contact with the paper picking wheel again.

Preferably, the printing assembly comprises a printing tray and a print head assembly which is pivotally coupled to the printing tray; the print head assembly comprises a fixed plate, an elastic element, a floating plate configured with a print head, and a lifting mechanism, wherein the floating plate comprises a top plate and a bottom plate; the top plate is located above the fixed plate while the bottom plate is located below the fixed plate; the elastic element is located between the fixed plate and the bottom plate in a compressed state as to provide downward pressure on the floating plate; the power output end of the lifting mechanism abuts against the lower surface of the top plate so that the floating plate can move up and down.

Preferably, the lifting mechanism comprises a driving assembly, a cam power shaft and a cam; the driving assembly is fixed on the upper surface of the fixed plate, the driving assembly is coupled to one end of the cam power shaft and the cam is secured on the cam power shaft, the driving assembly drives the cam power shaft to rotate around an axis of itself so as to drive the cam to take circles around the cam power shaft.

In addition, the invention further provides a self-service financial apparatus which comprises the preceding assembled note-issuing device.

The assembled note-issuing device and self-service financial apparatus provided by the present invention utilizes a note container, a paper delivery assembly, a printing assembly and a temporary storage assembly to handle the reservation, transmission, printing and temporary storage of notes. Thereby, when customers need to do note-related matters, they can operate the assembled note-issuing device conveniently. In this way, the time wasted in waiting for the bank tellers' operation will be greatly saved and the work efficiency of the bank tellers is enhanced too. Besides, the assembled note-issuing device also has the advantages of compact structure and little space usage.

BRIEF DESCRIPTION OF THE DRAWINGS

In order to more clearly illustrate the technical solutions of the embodiments according to the present invention, the figures of the embodiments will be briefly described hereinafter. Apparently, the described figures are merely some but not all of the embodiments of the present invention. Based on the figures of the present invention, other figures can be obtained by a skilled in the art without creative efforts.

DESCRIPTION OF THE PREFERRED EMBODIMENTS

The technical solutions in the embodiments of the present invention will be described hereinafter clearly and completely in combination with the accompanying drawings of the embodiments of the present invention. Apparently, the described embodiments are merely some but not all of the embodiments of the present invention. Based on the embodiments of the present invention, all other embodiments obtained by a skilled in the art without creative efforts shall fall within the protection scope of the present invention.

For convenience of description, the spatial relative terms such as "under", "below", "lower", "above", "upper" are utilized to describe relation between one element/feature and another element/feature shown in figures. It can be understood that when one element/layer is "on", "attached to" or "coupled to" another element/layer, it can be directly on, attached to or coupled to another element/lay, or intermediate element/lay(s) may exist between them.

It can be understood that the terms herein merely aim to describe specific embodiments rather than placing any limitation on this invention. When being used therein, the single terms "one" or "this" aim to include plural form unless other specific statements appear in context. Furthermore, terms such as "comprise" and/or "include" illustrate the existence of the character, unity, step, element and/or member rather than excluding the existence or addition of one or more characters, unities, steps, elements and/or members or combinations thereof. The following description is only about preferable embodiments of the present invention; however, it aims to illustrate the general principle of the present invention rather than placing any limitation on the scope of the present invention. The protection scope of the present invention should be subject to the protection scope defined by the claims.

Figure 1:
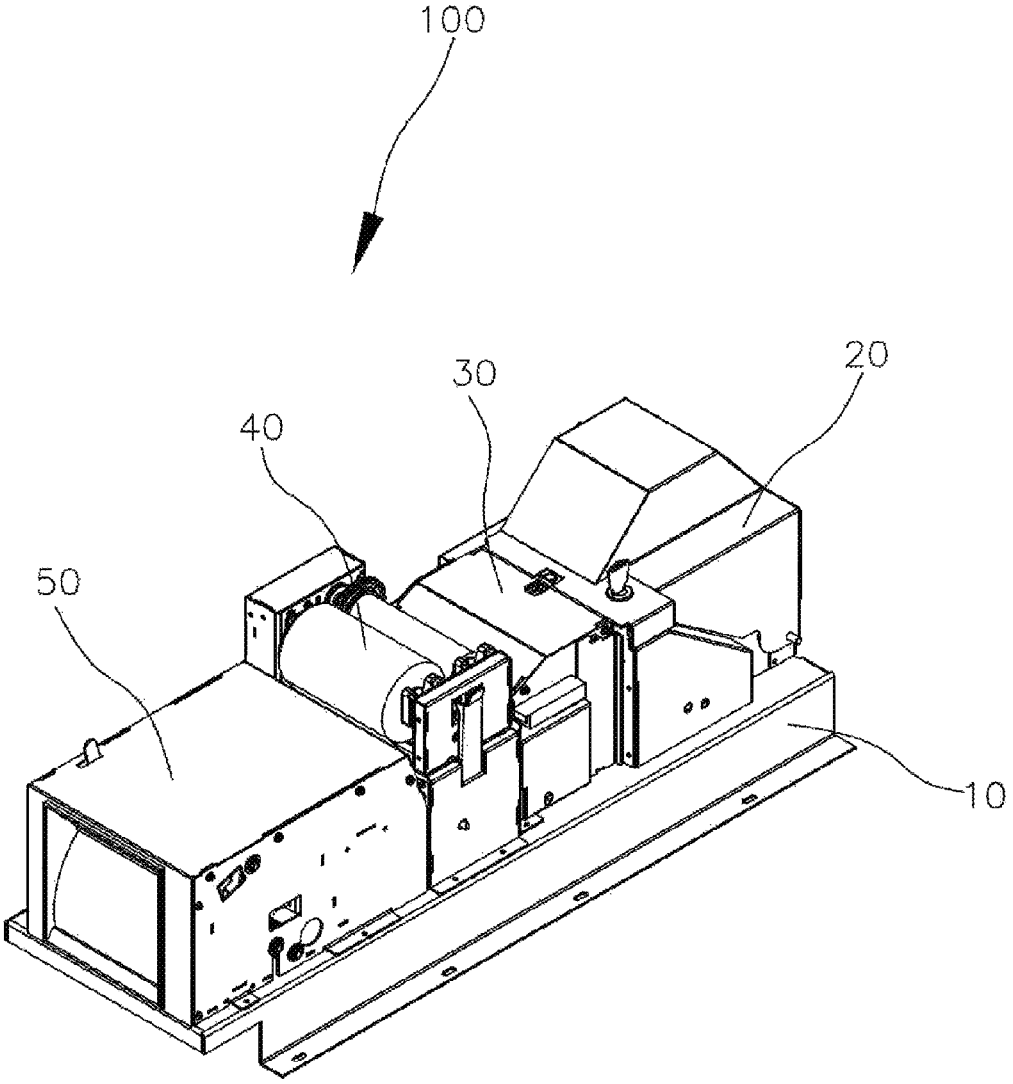
FIG. 1 is an overall schematic diagram of the assembled note-issuing device according to the embodiments of the present invention.
Figure 2:
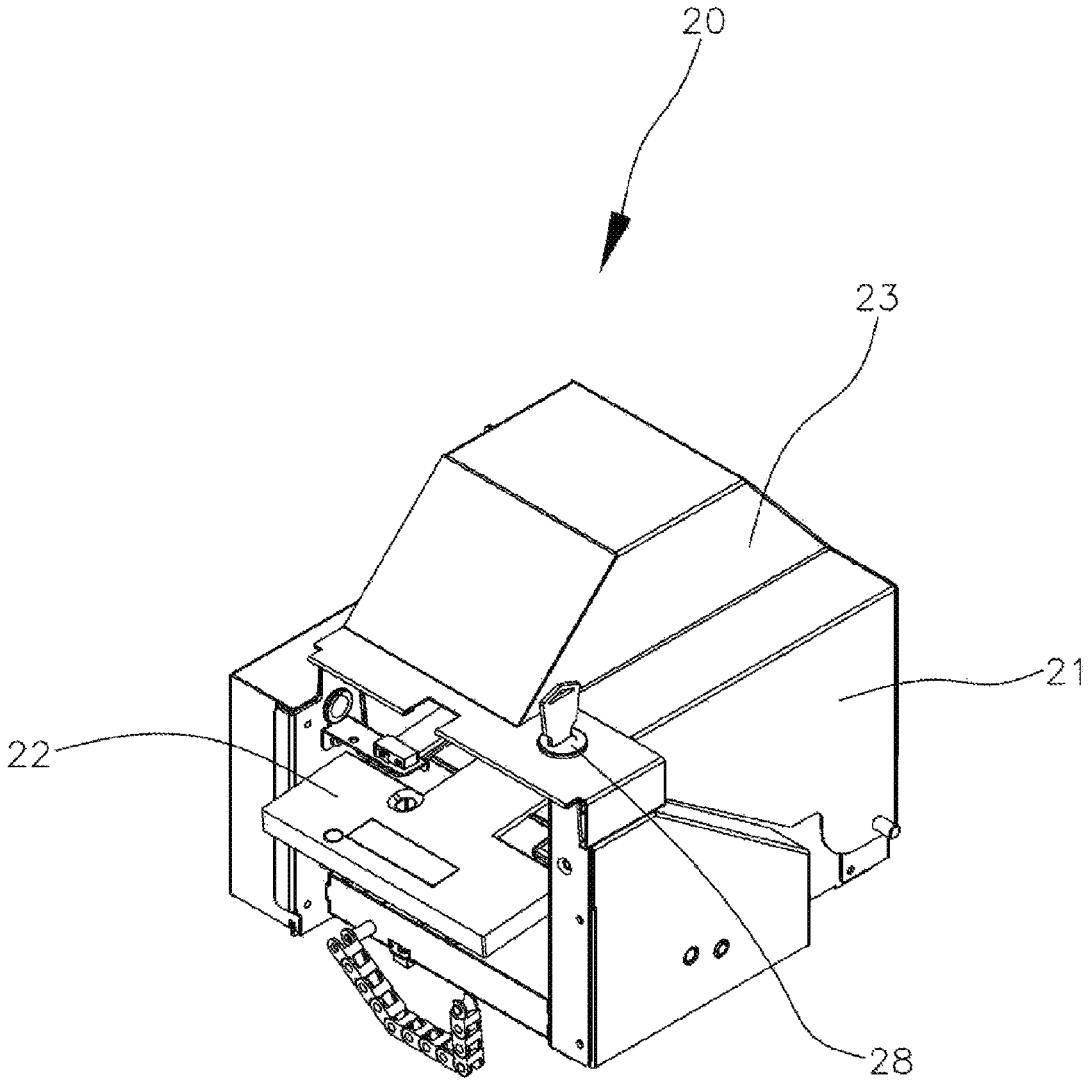
FIG. 2 is a schematic diagram of the note container according to the embodiments of the present invention.
Figure 3:
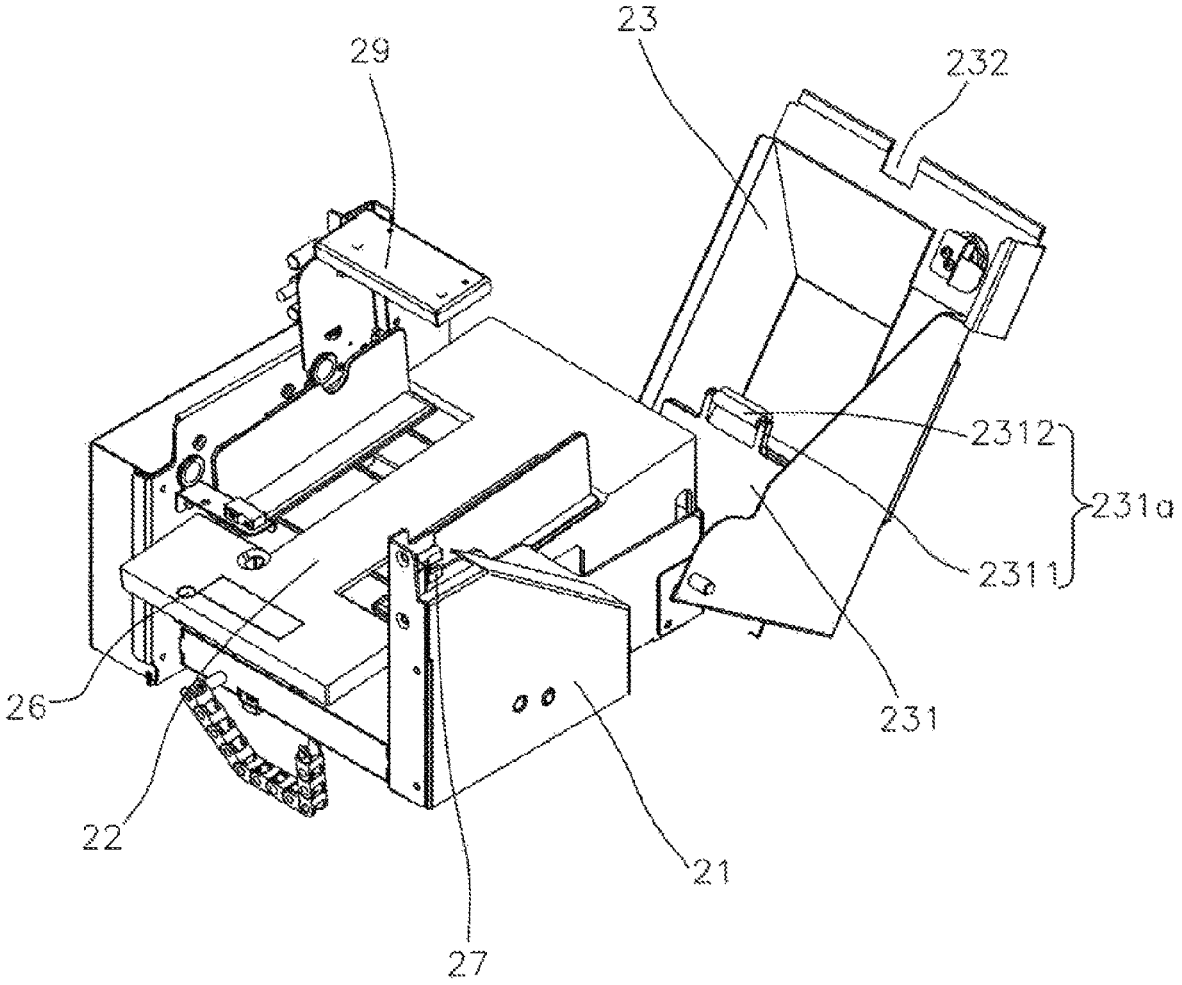
FIG. 3 is a schematic diagram of the note container in FIG. 2 with the lid open.
Figure 4:
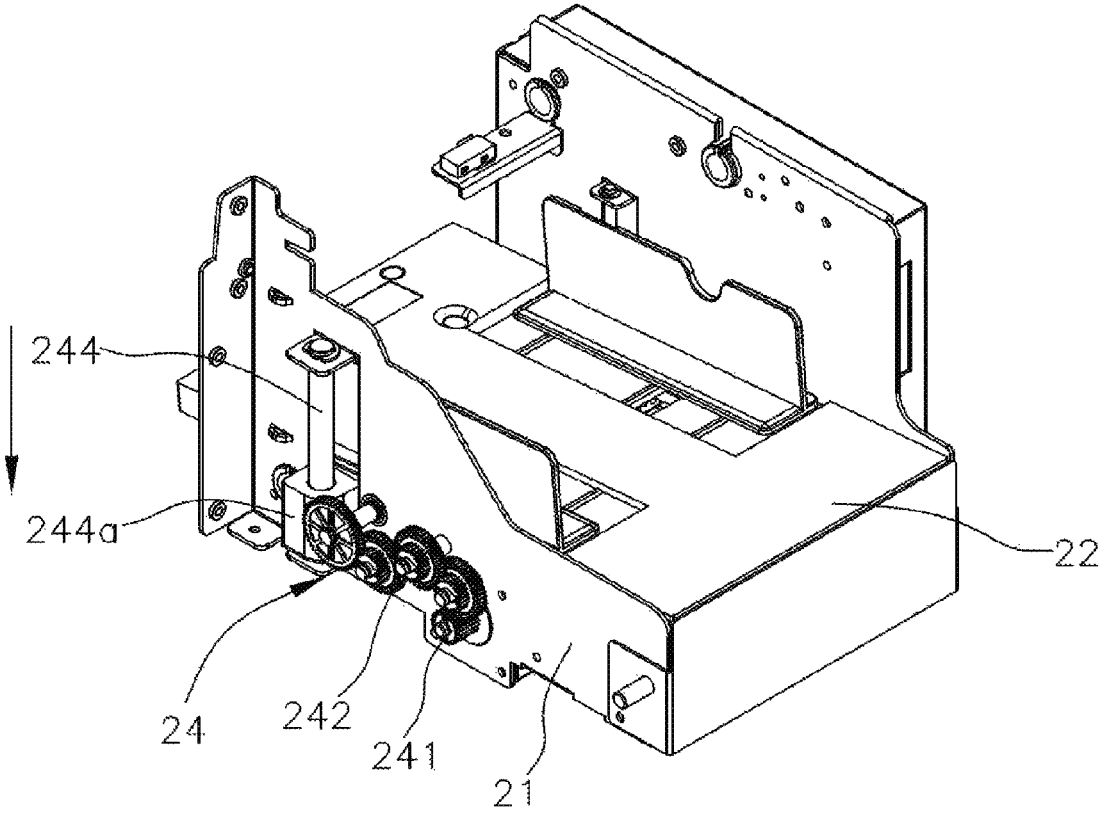
FIG. 4 is a schematic diagram of the note container according to the embodiments of the present invention in which the tray is located on the bottom.
Figure 5:
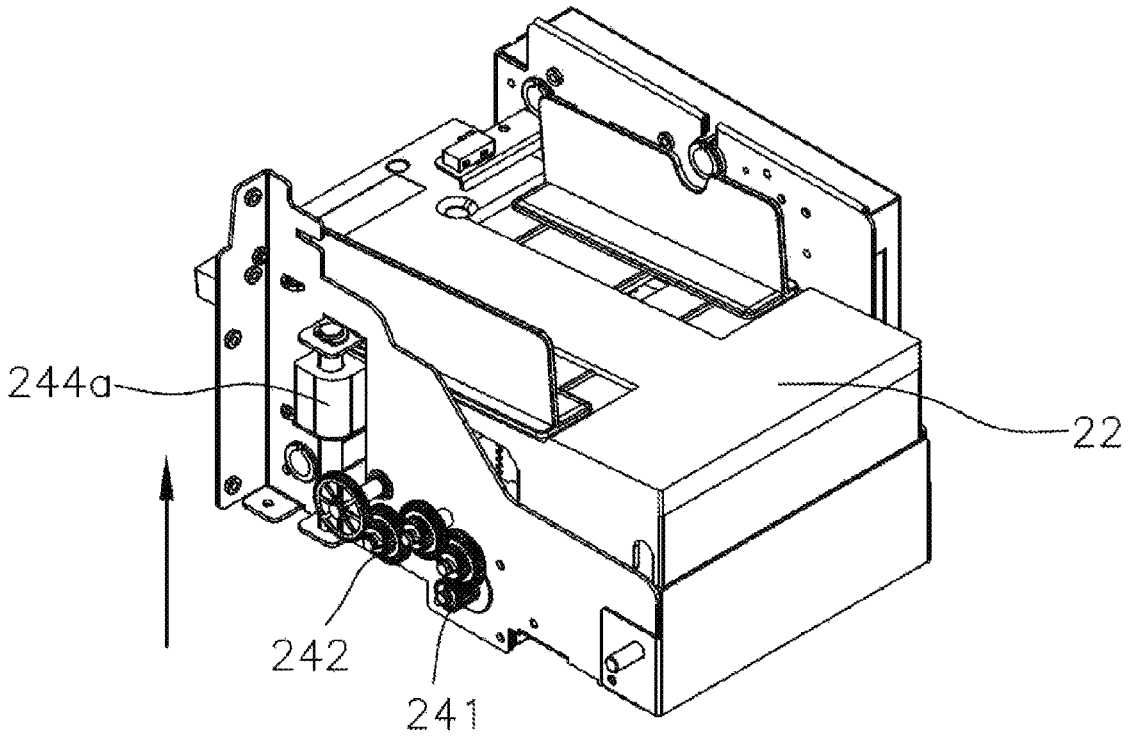
FIG. 5 is a schematic diagram of the note container according to the embodiments of the present invention in which the tray is moving up.

Referring FIG. 1, the assembled note-issuing device 100 disclosed by the present invention comprises a base 10, a note container 20, a paper delivery assembly 30, a printing assembly 40 and a temporary storage assembly 50 that are arranged on the base 10 successively. The paper delivery assembly 30, the printing assembly 40 and the temporary storage assembly 50 are interconnected with the note container 20 through a note channel 60. The paper delivery assembly 30 delivers the notes in the note container 20 to the printing assembly 40 through the note channel for printing, and the printing assembly 40 transfers the printed notes to the temporary storage assembly 50 for temporary storage.

Particularly, please referring FIGS. 1-5, the base 10 which is a rectangle base can be arranged inside the self-service financial apparatus so as to facilitate the operation of customers and bank staff and realize self-service printing and issuing of notes.

Notes (not shown) can be reserved in the note container 20 and the note container 20 includes a first housing 21 with an opening, a tray 22 for placing notes, a first lid 23 and a lifting device 24 attached to the first housing 21. The first housing 21 is arranged on the base 10 and the tray 22 is arranged in the first housing 21. A pressing plate 231 is configured in the first lid 23; the first lid 23 closes the opening of the first housing 21 so that the pressing plate 231 abuts against the notes on the tray 22. The lifting device 24 is arranged in the first housing 21 and is coupled to the tray 22 in order to drive the tray 22 to move up and down vertically. In the present embodiment, the first lid 23 is pivotally coupled to the first housing 21 through a shaft to render the first lid 23 open or close relative to the first housing 21 so as to place or pick up notes on the tray 22.

The pressing plate 231 includes a connecting end (not shown) and a paper pressing end 231*a* arranged oppositely, the connecting end is pivotally coupled to the inner wall of the first lid 23 through a torsion spring. The end surface of the paper pressing end 231*a* is arranged with a pressing block 2311 and a pressing shaft 2312, wherein the pressing shaft 2312 is configured in the pressing block 2311 and the pressing block 2311 abuts against the notes on the tray 22. Specifically, the pressing block 2311 protrudes from the end surface of the paper pressing end 231*a* and the pressing shaft 2312 is disposed through the pressing block 2311. When the first lid 23 closes relative to the first housing 21, the pressing plate 231 presses down towards the notes on the tray 22 under the force of self-gravity and the torsion spring so that the paper pressing end 231*a* abuts against the notes. At this time, the pressure from the pressing block 2311 and the pressing shaft 2312 can be used to press the paper surface of notes so as to prevent their corners from warping up and ensure the completeness of the subsequent mote image acquisition.

The lifting device 24 includes a first motor 241, a first gear cluster 242 and a rack (not shown), the first motor 241 is arranged on the first housing 21, the first gear of the first gear cluster 242 is coupled to the output shaft of the first motor 241, the rack is engaged with the last gear of the first gear cluster 242, and the tray 22 is secured to the rack. The first motor 241 drives the first gear cluster 242 to rotate so that the tray is driven to move up and down vertically by the rack. Particularly, the first gear cluster 242 is composed of two or more gears. When the first gear cluster includes a plurality of gears, every two adjacent gears are engaged with each other so as to lower the rotational speed output by the output shaft of the first motor 241 and thereby the speed of the tray 22 in vertical direction can be controlled.

Further, in order to ensure that the up-and-down movement of the tray 22 maintains in the vertical direction, the lifting device 24 also comprises a guiding shaft 244, a slid bush 244*a* is sleeved on the guiding shaft 244, the slid bush 244*a* is secured to the tray 22 so that the tray 22 moves along the direction of the guiding shaft 244. Because of the guiding function of the guiding shaft 244, the tray 22 always moves in the vertical direction without any departure.

Specifically, the positioning of the tray 22 can be realized by a sensor (not shown) and a reflective sensor 26. The sensor is arranged in the first housing 21 and the reflective sensor 26 is arranged on the tray 22. When the tray 22 is at the bottom, the sensor can detect a signal and the notes are to be put on the tray 22. When the notes are put on the tray 22, the reflective sensor 26 on the tray 22 detects a signal and actuates the first motor 241 to drive the tray 22 to move upward; until all the notes on the tray 22 are taken away, the reflective sensor 26 cannot receive a signal any more, the tray 22 is reset, i.e., goes back to the bottom.

Further, the note container 20 is equipped with a safety lock assembly so as to enhance the security of notes. The safety lock assembly comprises a sensor 27 and a safety lock 28, the safety lock 28 locks between the first housing 21 and the first lid 23, the sensor 27 is arranged at the bottom of the first housing 21 for checking the locking status of the safety lock 28. In the present embodiment, the safety lock 28 is a mechanical lock, and it locks the first lid 23 with the first housing 21 tightly when the first lid 23 covers the first housing 21. The sensor 27 is utilized to check the locking status. Preferably, a warning device may be arranged on the first housing 21 or the first lid 23 to cooperate with the sensor 27. When the sensor 27 detects that the first lid 23 is not completely locked with the first housing 21, it sends the information to the warning device and the warning device will sound an alarm or flash a light to inform the staff. By using the preceding device, the security of the note container 20 can be enhanced and the note container is only accessible for the bank staff or the operator.

Furthermore, the note container 20 also comprises a camera assembly 29 which is arranged on the first housing 21 and configured for photographing and recognizing the notes on the tray 22. Specifically, the camera assembly 29 is arranged in the opening of the first housing 21, a high definition camera is used to photograph the notes on the tray 22 and sends the photographs to the background software connected thereto.

It should be understood that the note container 20 can be used separately for storing notes in other embodiments.

Figure 6:
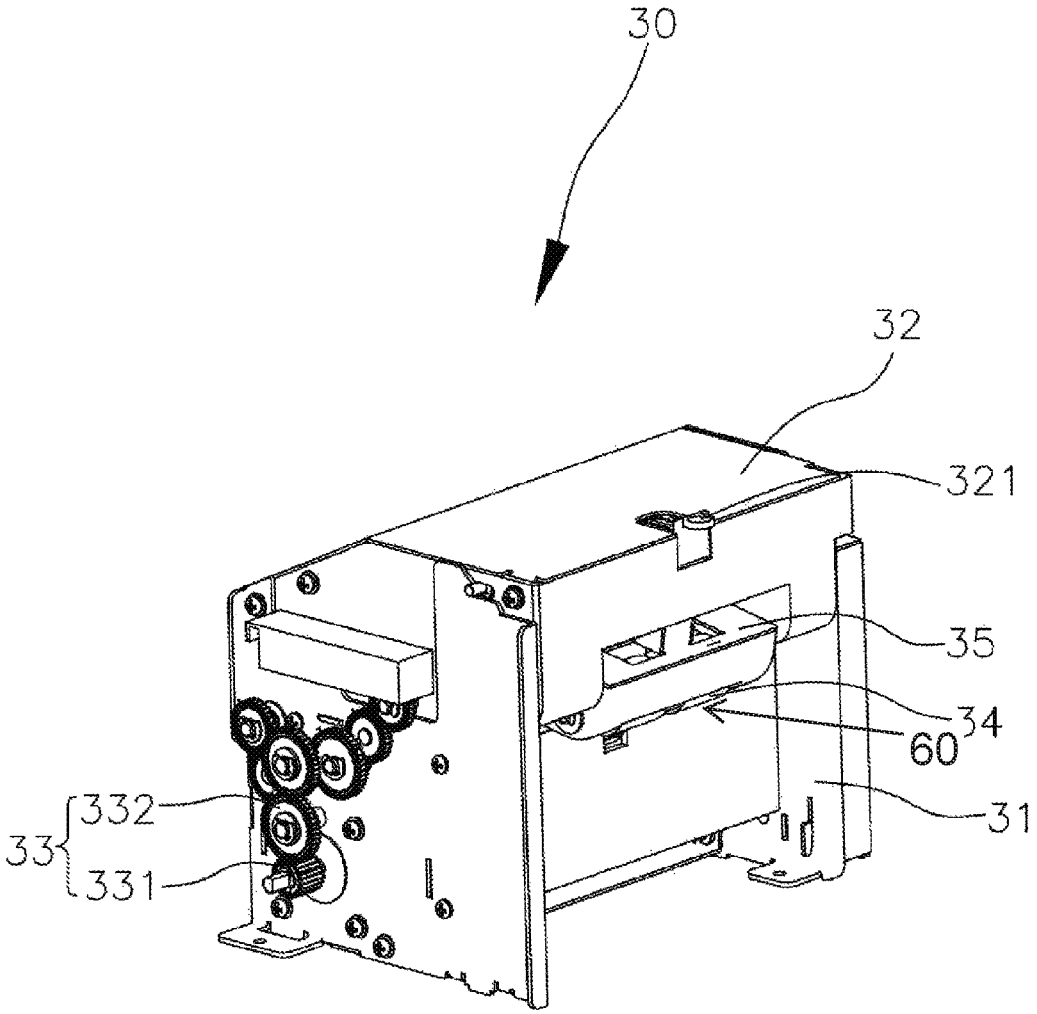
FIG. 6 is a schematic diagram of the paper delivery assembly according to the embodiments of the present invention.
Figure 7:
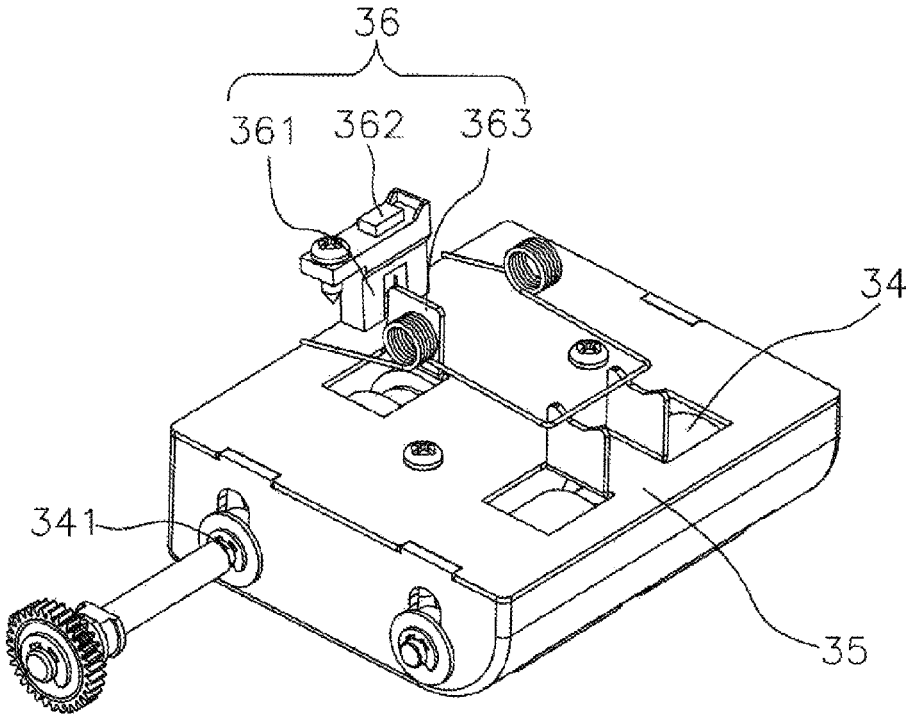
FIG. 7 is a schematic diagram of the paper picking wheel and related assembly of the paper delivery assembly according to the embodiments of the present invention.
Figure 8:
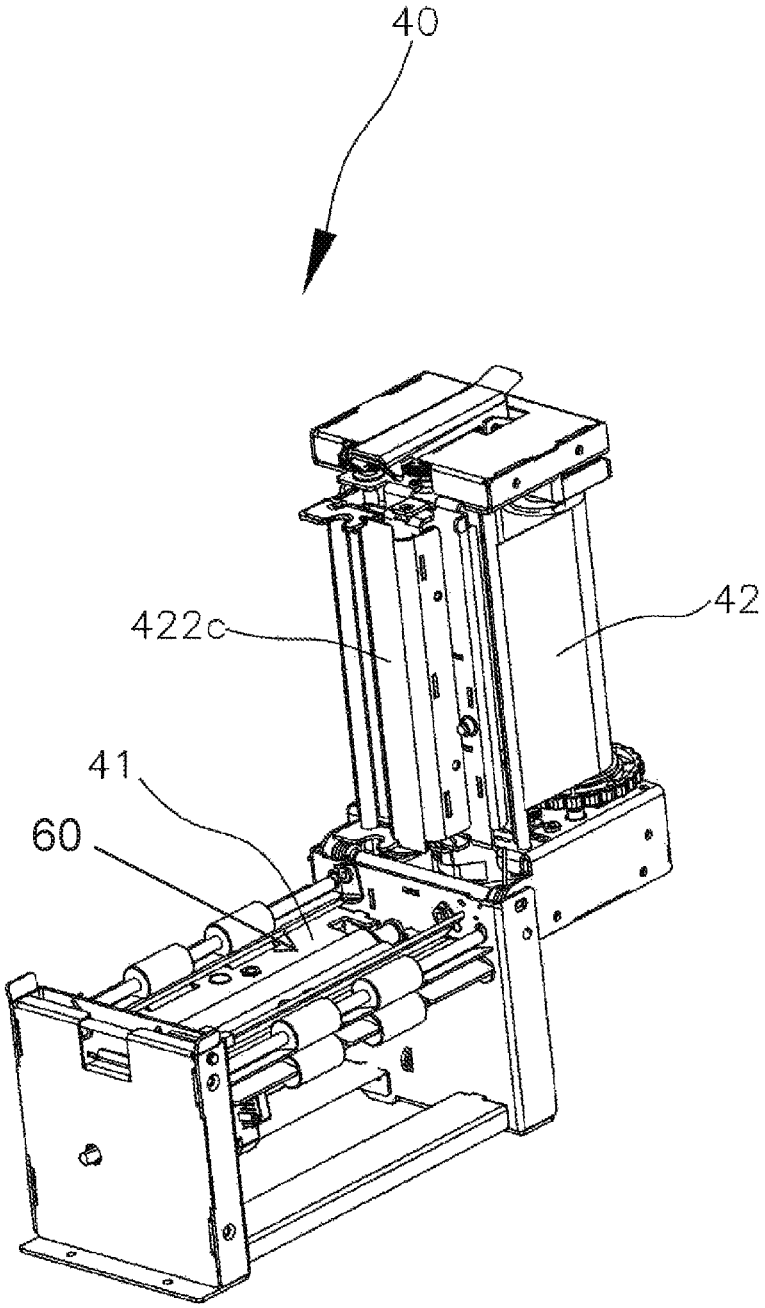
FIG. 8 is a schematic diagram of the printing assembly according to the embodiments of the present invention.
Figure 9:
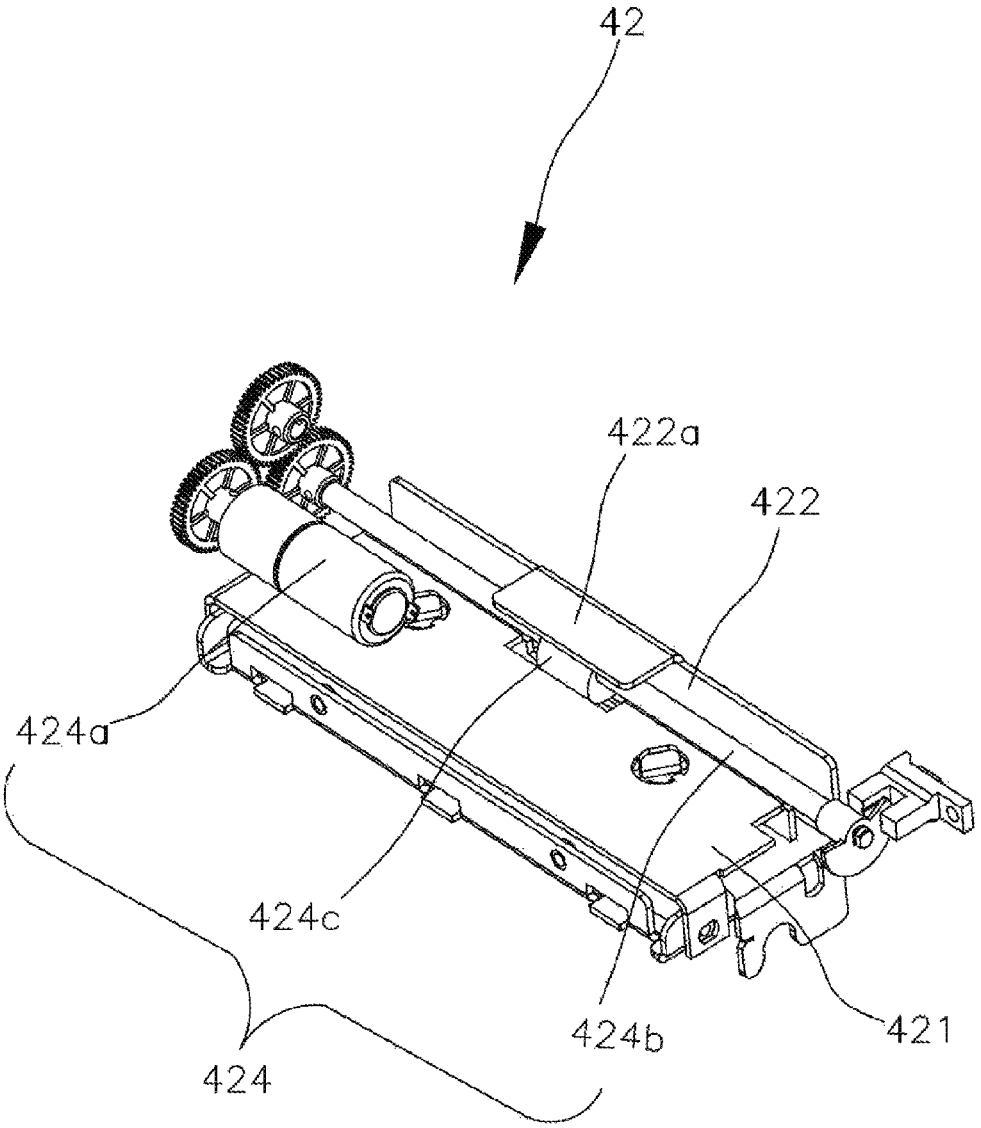
FIG. 9 is a schematic diagram of the portion of the print head assembly in FIG. 8 according to the embodiments of the present invention.
Figure 10:
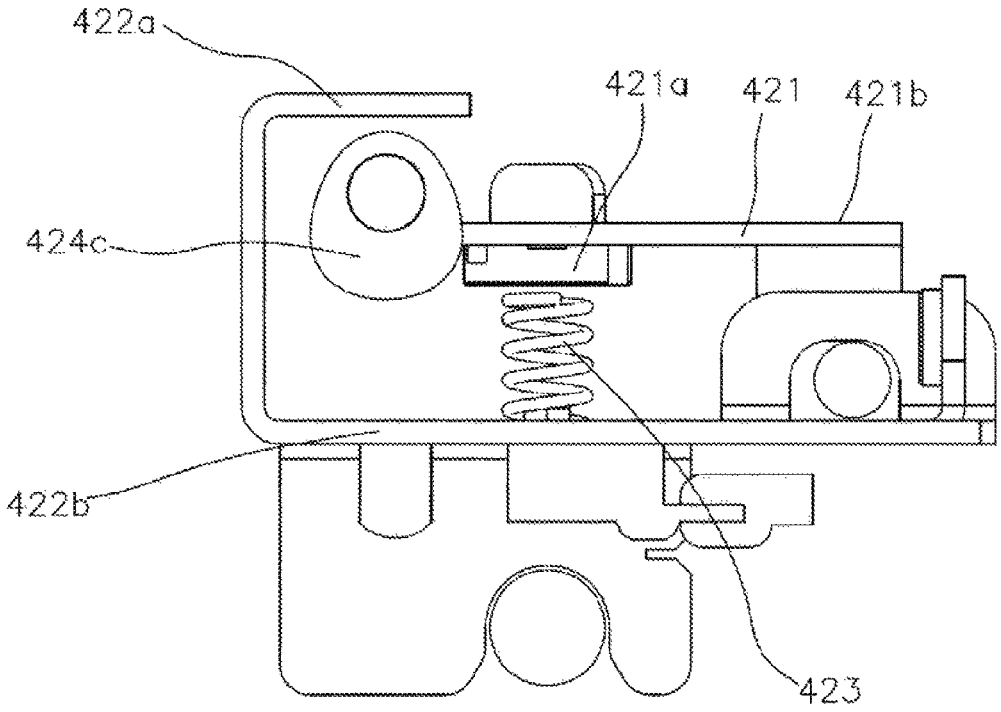
FIG. 10 is a schematic diagram of FIG. 9 from another view.
Figure 11:
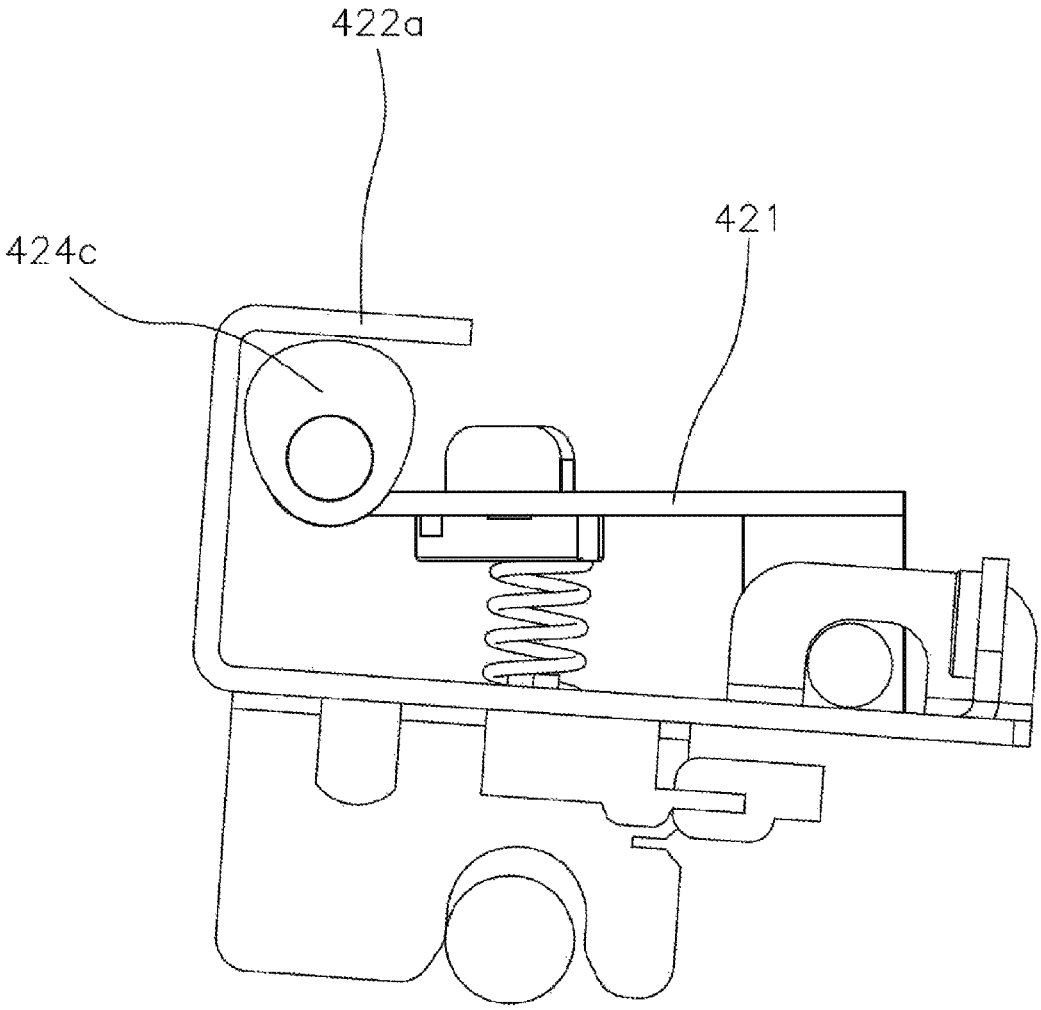
FIG. 11 is a schematic diagram of the printing assembly according to the embodiments of the present invention where the print head is lifted up.
Figure 12:
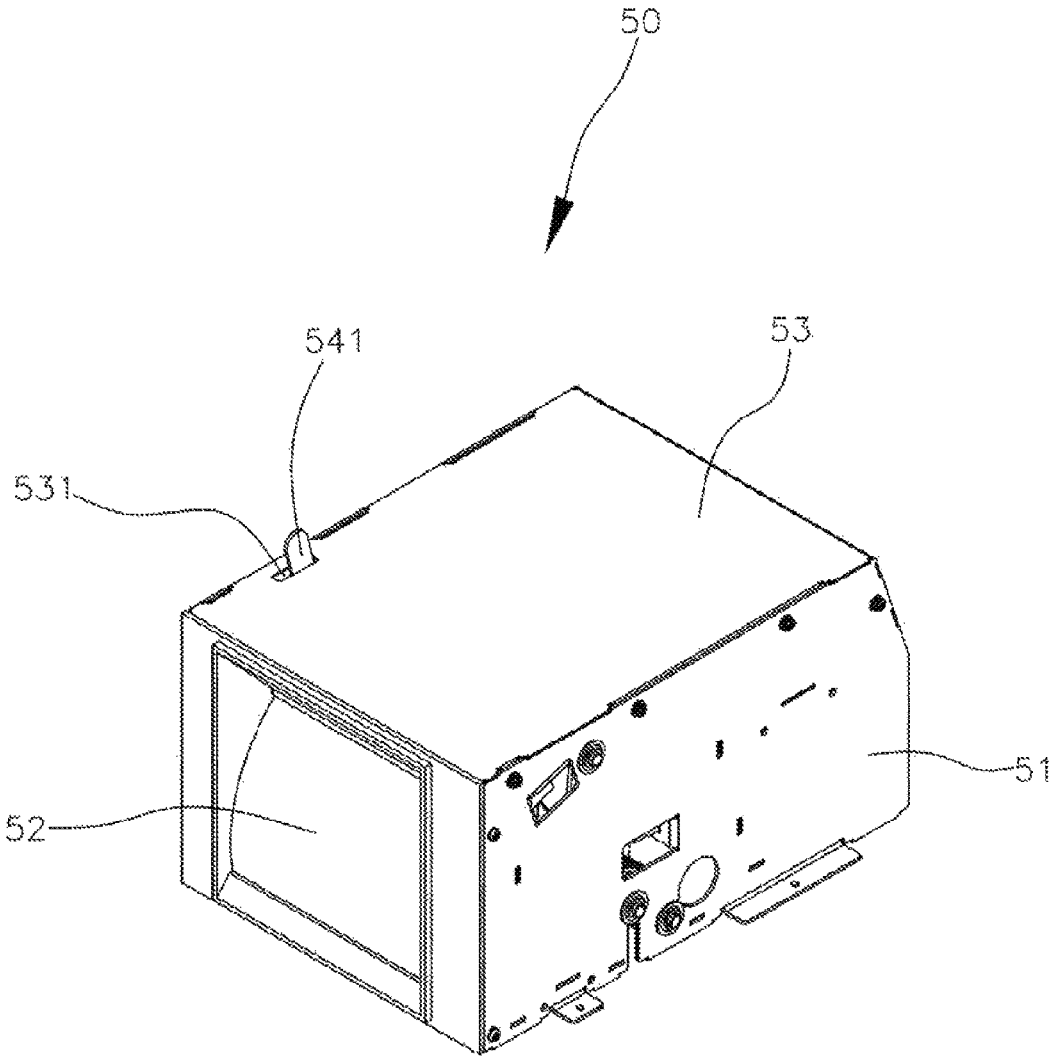
FIG. 12 is a schematic diagram of the temporary storage assembly according to the embodiments of the present invention.
Figure 13:
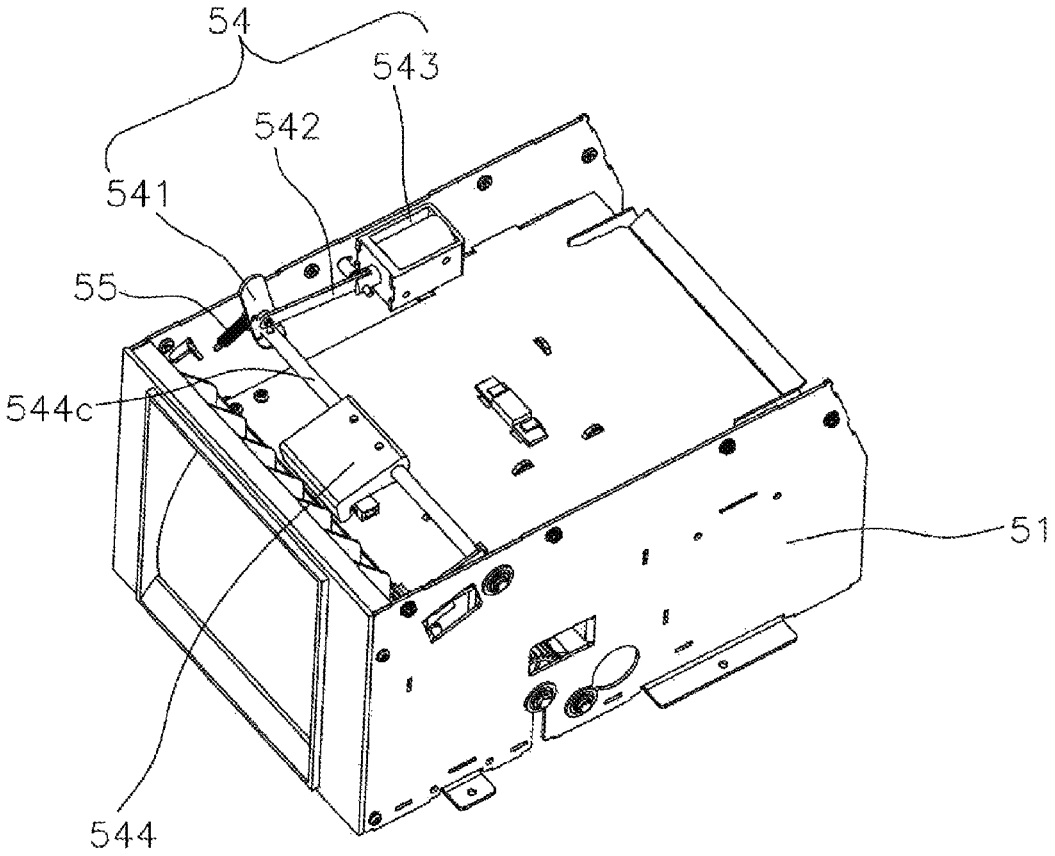
FIG. 13 is a schematic diagram of the temporary storage assembly according to the embodiments of the present invention (top lid omitted).

Referring FIGS. 6-7, the paper delivery assembly 30 is secured to the exit side of the note container 20 and comprises a second housing 32 and a second lid pivotally coupled to the second housing 31. In the present embodiment, the second housing 31 is configured with an opening that interconnected with the first housing 21, and the second lid 32 is pivotally coupled to the second housing 31 through a shaft. In order to enhance the security of the assembled note-issuing device, a hasp 321 is arranged on the second lid 32 and a staple 232 is arranged on the position on the first lid 23 of the note container 20 corresponding to the hasp 321. When the second lid 32 covers the second housing 31, the hasp 321 is engaged with the staple 232. Because the first lid 23 is configured with the safety lock assembly, the second lid 32 can only be opened after the safety lock assembly is unlocked. The note container 20 and the paper delivery assembly 30 can be locked at the same time by using the safety lock assembly, and thereby overall security of the assembled note-issuing device 100 is enhanced, meanwhile, the number of members is lessened and the operation becomes more convenient. The second lid 32 is pivotally coupled to the second housing 31. Therefore, when notes are stuck in the paper delivery assembly 30, the malfunction can be handled by opening the second lid 32, so that the regular usage and operation of the assembled note-issuing device 100 can be ensured.

It is understandable that the paper delivery assembly 30 can be used in combination with the note container 20 or separately depending on particular situation.

Furthermore, the paper delivery assembly 30 further comprises a first driving mechanism 33 and a paper picking wheel 34 arranged in the second housing 31 and the first driving mechanism is arranged on one side of the second housing 31. In the present embodiment, the first driving mechanism 33 comprises a second motor 331 and a second gear cluster 332, the first gear of the second gear cluster 332 is coupled to the output shaft of the second motor 331, a shaft 341 is arranged through the paper picking wheel 34, the shaft 34 is attached to the last gear of the second gear cluster 332, the second motor 331 drives the second gear cluster 332 to rotate and consequently drives the paper picking wheel 34 to rotate around the shaft 341. Specifically, the second gear cluster 332 is composed of two or more gears. When the second gear cluster includes a plurality of gears, every two adjacent gears are engaged with each other so as to lower the rotational speed output by the output shaft of the second motor 331 and thereby the rotational speed of the paper picking wheel 34 can be controlled.

In particular, there are two paper picking wheels 34 and shafts 341 are arranged through these two paper picking wheels 34, the two shafts are driven by a belt drive, wherein one of the shafts 341 is coupled to the last gear of the second gear cluster 332 and transmits the power to another shaft, and drives another paper picking wheel 34 to rotate.

Further, the paper picking wheel 34 is arranged in a casing 35 and one end of the shaft 34 protrudes out of the casing 35 to realize the connection between the shaft 341 and the second gear cluster 332 so that the shaft 341 and the paper picking wheel 34 is driven by the second gear cluster 332 to rotate in the casing 35.

Still further, the paper delivery assembly 30 also comprises a sensing assembly 36 which further comprises a sensor support 361, a sensor 362 and a baffle 363. In particular, the casing 35 has an outer end surface, the sensor support 361 is configured with a slot for the baffle 363 to insert and the slot is positioned corresponding to the sensor 362. The sensor 362 is secured to the sensor support 361.

One end of the baffle 363 is secured to the outer surface of the casing 35. In the present embodiment, the baffle 363 is a square plate. When the tray 22 moves upward until the notes thereon contact with the paper picking wheel 34, the notes abut against the paper picking wheel 34 and lift it upward whereby the casing 35 drives the baffle 363 to rotate into the slot of the sensor support 361, that is, the notes jacks the paper picking wheels up so that the baffle 363 is lifted upward. Meanwhile, the second motor 331 actuates the paper picking wheel 34 to pick up papers. Because the baffle 363 is located in the slot of the sensor support 361, i.e., the baffle blocks the sensor form detecting signals, the first motor 241 drives the tray 22 to go on moving upward. After a delay of N steps, the first motor 241 stops, at that time, the tray 22 stops moving upward and the paper picking wheel starts to pick up papers under the actuation of the second motor 331.

When the notes on the tray 22 lessens, the paper picking wheel drops down and the separation between the notes and the paper picking wheel 34 leads the baffle 363 to leave the slot of the sensor support 361. At the moment, the sensing result of the sensor 362 actuates the first motor 241 to drive the tray 22 to move upward until the notes on the tray 22 contact with the paper picking wheels 34 again. Because the baffle 363 leaves the slot of the sensor support 361, the sensor 362 can actuate the first motor 241 to drive the tray 22 to move upward until the notes on the tray 22 contact with the paper picking wheels 34 again, i.e., the first motor 241 stops after rotating for N steps. The procedure above will be repeated until the notes on the tray are all picked up. It is understandable that the number of delayed steps N is in reverse proportion to the frequency of automatic compensation, and it can be set according to different requirements.

The sensing result of the sensor 362 actuates the first motor 241 and consequently drives the tray 22 to move to the pre-set position via the first motor 241 so that the compensation of notes can be accomplished. Meanwhile, the second motor 331 is employed to drive the paper picking wheel 34 to pick up papers, so no operator is needed to observe the quantity of notes and performance of the paper picking wheel 34 and thereby operators' workload can be lightened.

Referring FIGS. 1, 8 to 11, the printing assembly 40 comprises a printing tray 41 and a print head assembly 42 which is pivotally coupled to the printing tray 41. In the present embodiment, the note channel 60 is configured on the printing tray 41 so that the paper delivery assembly 30 transmits notes to the printing tray 41.

The print head assembly 42 comprises a fixed plate 421, a floating plate 422, an elastic element 423 and a lifting mechanism 424, wherein the floating plate 422 comprises a top plate 422*a* and a bottom plate 422*b*. The top plate 422*a* is located above the fixed plate 421 while the bottom plate is located below the fixed plate 421. The elastic element 423 is located between the fixed plate 421 and the bottom plate 422*b* in a compressed state so as to provide downward pressure on the floating plate 422. The lifting mechanism 424 abuts against the lower surface of the top plate 422*a* so that the floating plate 422 can move up and down. In the present embodiment, a print head 422*c* covered with carbon ribbon is arranged on the floating plate 422.

The elastic element 423 may be a spring or a leaf spring, or any other metal or plastic elastic element with good performance. In particular, an elasticity adjusting block 421*a* is arranged on the fixed plate 421, the elastic element 423 is attached with the elasticity adjusting block 421*a* and the elastic element 423 is compressed between the elasticity adjusting block 421 and the bottom plate 422*b* of the floating plate 422 in order to provide downward pressure on the floating plate 422. There may be one, two or a plurality of elastic elements 423 and the number of the elasticity adjusting blocks 421*a* matches with the number of the elastic elements 423. Preferably, two elastic elements and two elasticity adjusting blocks are located on the fixed plate 421 symmetrically.

The lifting mechanism 424 comprises a driving assembly 424*a*, a cam power shaft 424*b* and a cam; the driving assembly 424*a* is arranged on the upper surface 421*a* of the fixed plate 421, the driving assembly 424*a* is coupled to one end of the cam power shaft 424*b* and the cam is secured on the cam power shaft 424*b*, the driving assembly 424*a* drives the cam power shaft 424*b* to rotate around an axis of itself so as to drive the cam 424*c* to take circles around the cam power shaft 424.

In the present embodiment, the cam 424*c* is an eccentric cam comprising a top and a bottom. When the cam 424*c* moves to its top and abuts against the top plate 422*a*, the floating plate 422 drives the print head 422*c* move up so as to prevent the carbon ribbon of print head 422*c* from moving with notes and thereby the waste of the carbon ribbon can be avoided. When the cam 424*c* moves to its bottom and abuts against the top plate 422*a*, the floating plate 422 drives the print head to move downward under the pressure of the elastic element 423 so that the carbon ribbon is pressed down and the printing is accomplished.

In the present embodiment, the number of the cams 422*c* can be one or more; when there are a plurality of cam 422*c*, these cams 422*c* can be arranged on the cam power shaft 422*b* at intervals or adjacently. One side of the fixed plate 421 near the cam power shaft 422*b* is configured with a notch whose position is corresponding to the position of the cam 422*c*, in this way, the rotation of the cam 422*c* will not be effected by the contact between the top of the cam 422*c* and the fixed plate 421.

The driving assembly 424*a* comprises a motor and a gear train, the motor is arranged on the upper surface 421*b* of the fixed plate 421, the output shaft of the motor is coupled to the input end of the gear train, and the output end of the gear train is coupled to one end of the cam power shaft 422*b*. The gear train is utilized to reduce the rotation speed output by the motor and thereby to control the rotation speed of the cam power shaft 422*b*.

It is understandable that in the present embodiment, the printing assembly 40 can work in combination with the paper delivery assembly 30 and the note container 20. Of course, the printing assembly 40 also can work separately for note printing.

Referring FIGS. 1, 12 to 16, for further improvement, the assembled note-issuing device 100 further comprises a temporary storage assembly 50, the temporary storage assembly 50 is coupled to the base 10 in a detachable manner, that is, the temporary storage assembly 50 can work separately or in combination with the note container 20, the paper delivery assembly 30 and the printing assembly 40. The temporary storage assembly 50 is arranged at one side of the printing assembly 40. Besides, a transmission channel (not shown) interconnected with the note channel 60 is configured in the temporary storage assembly 50 so that the printed notes can be transmitted to the temporary storage assembly 50 via the transmit channel for users to pick. In the present embodiment, the temporary storage assembly 50 comprises a casing 51 and a gate 52, wherein the casing 51 comprises a receiving room with an opening, the gate 52 is coupled to the casing 51 pivotally so as to close the opening of the casing. Specifically, the gate 52 has an arc-shaped body and it can be pulled up or released down so that the gate 52 can be open or close in relative to the casing 51. Because the gate 52 is pivotally coupled to the casing 51, it is convenient for the operator to take notes when the gate is open; meanwhile, it can prevent others to take notes when the gate 52 is close so as to ensure the security of the notes in the assembled note-issuing device 100.

Furthermore, the temporary storage assembly 50 also comprises a top lid 53 and a locking assembly 54, the top lid 53 is secured to the casing 51 and the casing has an opening on the top which can be covered by the top lid 53. Specifically, the locking assembly 54 comprises an unlocking handle 541, a link rod 542, an electromagnetic valve 543 and a latch 544, wherein a sliding groove 531 is arranged on the top lid 53 and the unlocking handle 541 protrudes through the sliding groove 531. In particular, the unlocking handle 541 is a U-shaped body strip, when the device is powered off, the gate 52 can be opened or closed manually by changing the location of the unlocking handle 541 in the sliding groove 531.

Figure 14:
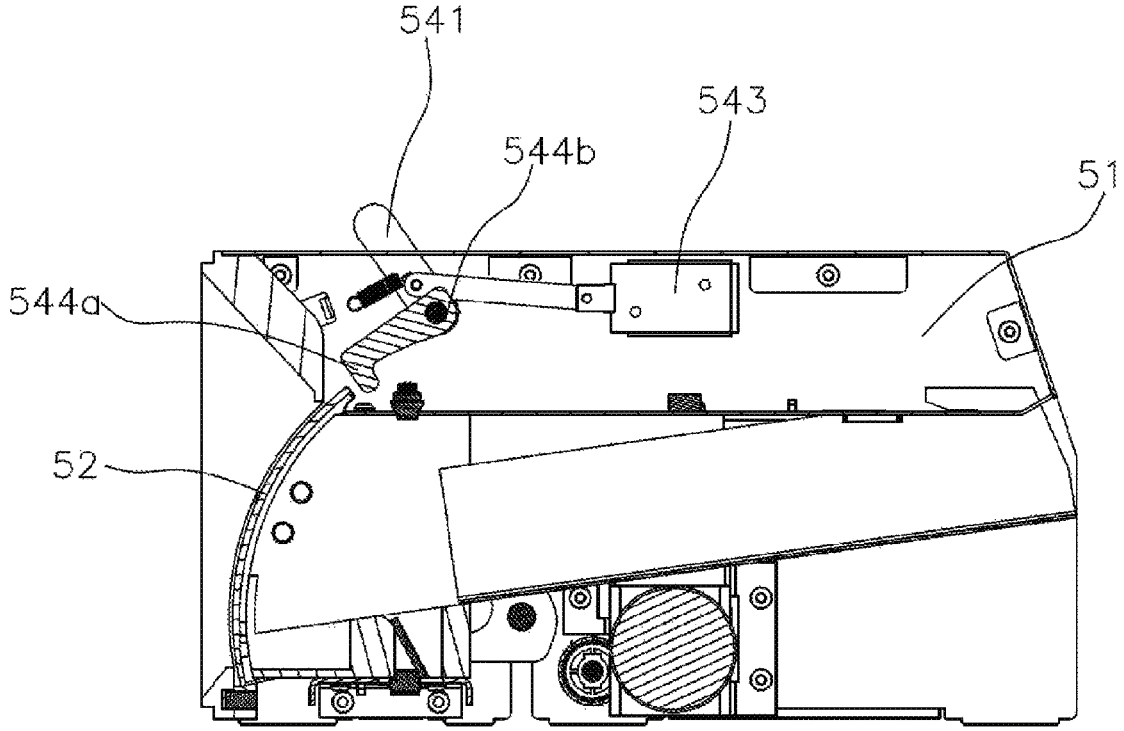
FIG. 14 is a schematic diagram of the temporary storage assembly according to the embodiments of the present invention where the gate is locked closely.
Figure 15:
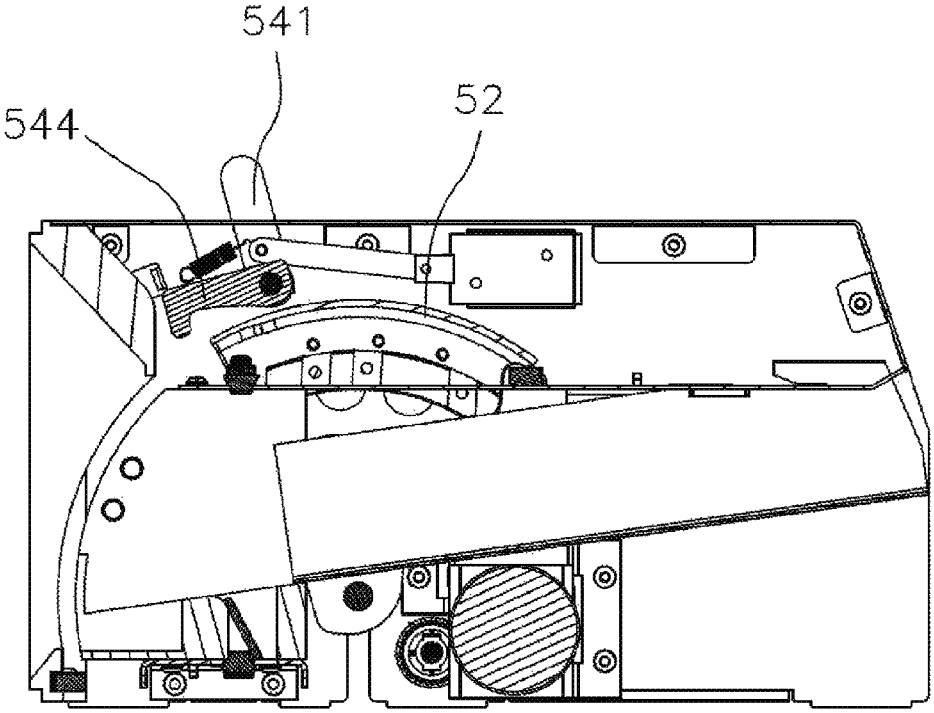
FIG. 15 is a schematic diagram of the temporary storage assembly according to the embodiments of the present invention where the gate is open.
Figure 16:
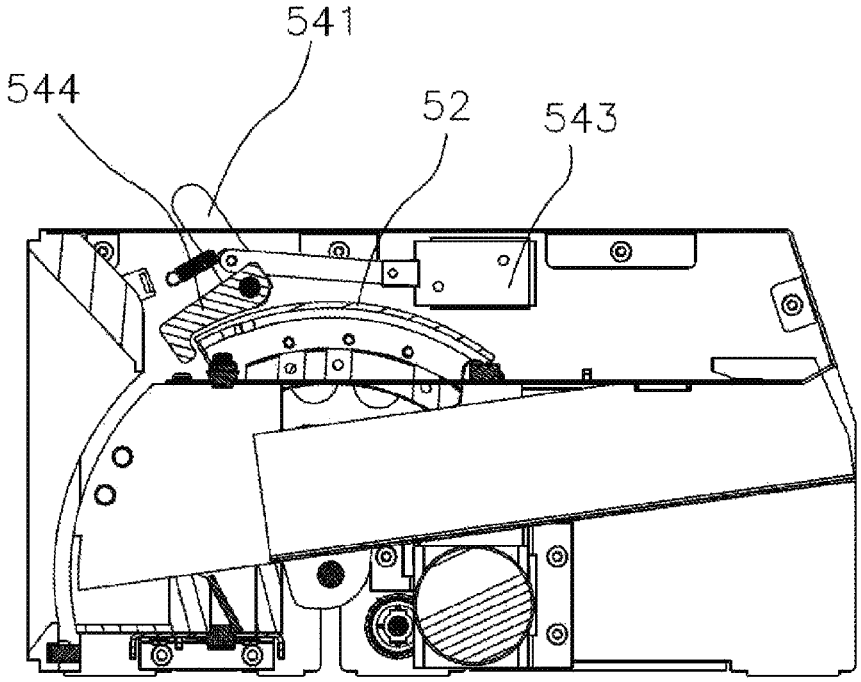
FIG. 16 is a schematic diagram of the temporary storage assembly according to the embodiments of the present invention where the gate is locked in open state.

The electromagnetic valve 543 is fixed in the casing 51, the other end of the unlocking handle 541 is coupled to the electromagnetic valve 543 via the link rod 542. The latch 544 located in the casing 51 comprises an abut end 544*a* and a rotary end 544*b*, the rotary end 544*b* is pivotally coupled with the unlocking handle 541 through the latch shaft 544*c* and the abut end 544*a* is arranged to face the gate 52. In the present embodiment, when the unlocking handle 541 is stirred to slide to and abut against the first end of the sliding groove 531 (the first end of the sliding groove is the end facing the printing assembly 40), the latch shaft 544*c* drives the latch 544 to rotate and make the abut end 544*a* away from the gate 52, and then the gate is unlocked. The gate 52 can be pulled up relative to the casing 51 thereby. When the unlocking handle 541 is released, the latch 544 hooks the lower edge of the gate 52 to pull it open (as shown in FIG. 16). When the unlocking handle 541 is stirred to slide to and abut against the second end of the sliding groove 531 (the second end of the sliding groove 531 is the end away from the printing assembly 40), the latch shaft 544*c* drives the latch 544 to rotate so that the abut end 544*a* abuts against the upper edge of the gate to close the gate (as shown in FIG. 14), at that time, the gate 52 is close.

Someone else other than the operator is prevented to take the notes in the casing 51 by using the locking assembly 50 to control the open and close of the gate 52, and thereby the note security of the assembled note-issuing device can be ensured.

Furthermore, the temporary storage assembly 50 also comprises an elastic member 55 and the casing 51 is configured with a projection (not shown) at the position adjacent to the gate 52, the two ends of the elastic member are respectively coupled with the unlocking handle 541 and the projection so as to provide restoring force for restoration of the unlocking handle 541. Preferably, the elastic member is a spring. Particularly, in the original state, the unlocking handle 541 is located at the second end of the sliding groove 531 under the force of the spring 55, the latch 544 abuts the upper edge of the gate and renders the gate locked; when the unlocking handle 541 (located at the other end of the sliding groove 531) is stirred, the latch is driven to rotate, and the gate is unlocked. Then, the unlocking handle 541 is released again, the latch hooks the lower edge, the gate will stay open and will not drop down.

It can be understood that opening the gate by using the unlocking handle 541 aims to enable the operators to open the gate manually in the situation of power cutoff or maintenance. However, when the apparatus operates normally, the electromagnetic valve 543 is controlled by electrical circuits and thereby drives the latch to rotate so as to realize the open/close of the gate 52. The principle of it is identical with that of the preceding unlocking handle and is omitted here.

In addition, the invention further provides a self-service financial apparatus which comprises the preceding assembled note-issuing device to enable customers to deal with note-related business by themselves.

The assembled note-issuing device 100 and self-service financial apparatus provided by the present invention utilizes a note container 20, a paper delivery assembly 30, a printing assembly 40 and a temporary storage assembly 50 to handle the reservation, transmission, printing and temporary storage of notes. Thereby, when customers need to do note-related matters, they can operate the assembled note-issuing device 100 conveniently. In this way, the time wasted in waiting for the bank tellers' operation will be greatly saved and the work efficiency of the bank tellers is enhanced too. Besides, the assembled note-issuing device 100 also has the advantages of compact structure and little space usage.

In the description of the invention, terms such as "an embodiment", "some embodiments", "example", "particular examples", "some examples" or "first embodiment" tend to mean that the specific features, structures, materials or characters described in the embodiment or example are included in at least one embodiment or example of the present invention. In the specification, the illustratively presentation of the preceding terms is unnecessarily indicated the same embodiment or example. Moreover, the specific features, structures, materials or characters can be combined in suitable manners in any one or more embodiments.

The embodiments described above should not be taken as limitations of the protection scope of the present technical solution. Any alterations, equivalent replacements and modifications without departing from the spirit of this invention shall fall in the protection scope of the present invention.

What is claimed is:

1. An assembled note-issuing device comprising a base, a note container, a paper delivery assembly, a printing assembly and a temporary storage assembly that are arranged on the base successively; wherein the paper delivery assembly, the printing assembly and the temporary storage assembly are connected to the note container by a note channel; the paper delivery assembly delivers notes in the note container to the printing assembly through the note channel for printing, and the printing assembly transfers printed notes to the temporary storage assembly for temporary storage;

the temporary storage assembly comprises a casing, a gate, a top lid and a locking assembly; the casing comprises a receiving room with an opening, the gate is coupled to the casing pivotally so as to close the opening of the casing, and the top lid is secured to the casing; the locking assembly comprises an unlocking handle, a link rod, an electromagnetic valve and a latch; a sliding groove is configured on the top lid, one end of the unlocking handle protrudes through the sliding groove, the electromagnetic valve is fixed in the casing, the unlocking handle is coupled to the electromagnetic valve via the link rod, the latch located in the casing comprises an abut end and a rotary end, the rotary end is pivotally coupled with the unlocking handle through a latch shaft and the abut end is configured to face the gate;

when the unlocking handle is stirred to slide to and abut against a first end of the sliding groove, the latch shaft drives the latch to rotate so that the abut end goes away from the gate; at that time, the gate is unlocked;

when the unlocking handle is stirred to slide to and abut against a second end of the sliding groove, the latch shaft drives the latch to rotate so that the abut end gets close to the gate and renders the gate locked.

2. The assembled note-issuing device according to claim 1, characterized in that the temporary storage assembly also comprises an elastic member, the two ends of the elastic member are respectively coupled with the unlocking handle and the casing so as to provide restoring force for restoration of the unlocking handle.

3. A self-service financial apparatus characterized by comprising the assembled note-issuing device according to claim 2.

4. The assembled note-issuing device according to claim 1, characterized in that the note container comprises a first housing with an opening, a tray for placing notes, a first lid rotately attached to the first housing, and a lifting device; the first housing is arranged on the base and the tray is arranged in the first housing, a pressing plate is configured in the first lid; when the first lid closes the opening of the first housing, the pressing plate abuts against the notes on the tray; the lifting device is coupled to the tray in order to drive the tray to move up and down vertically.

5. The assembled note-issuing device according to claim 4, characterized in that the lifting device includes a first motor, a first gear cluster and a rack , the first motor is arranged on the first housing, a first gear of the first gear cluster is coupled to an output shaft of the first motor, the rack is engaged with a last gear of the first gear cluster, and the tray is attached to the rack so that the tray is driven to move up and down vertically by the rack when the first motor drives the first gear cluster to rotate.

6. The assembled note-issuing device according to claim 1, characterized in that the paper delivery assembly comprises a second housing, a second lid pivotally coupled to the second housing, a first driving mechanism and a paper picking wheel arranged in the second housing; the first driving mechanism comprises a second motor and a second gear cluster, a first gear of the second gear cluster is attached to an output shaft of the second motor, a shaft is arranged through the paper picking wheel and the shaft is attached to a last gear of the second gear cluster, the second motor drives the second gear cluster to rotate and consequently drives the paper picking wheel to rotate around the shaft.

7. The assembled note-issuing device according to claim 6, characterized in that the paper delivery assembly also comprises a casing and a sensing assembly; the paper picking wheel is located in the casing, the casing has an outer end surface, the sensing assembly comprises a sensor support, a first sensor and a baffle; the first sensor is secured to the sensor support, the sensor support is configured with a slot for the baffle to insert and one end of the baffle is secured to the outer surface of the casing;

when the tray moves upward vertically until the notes thereon contact with the paper picking wheel, the notes abut against and lift up the paper picking wheel and thereby the paper picking assembly drives the baffle to move into the slot of the sensor support, meanwhile, the tray stops moving upward and the second motor actuates the paper picking wheels to pick up papers;

when the notes on the tray lessens, the notes separate with the paper picking wheel and separation therebetween leads the baffle to leave the slot of the sensor support; at that time, the first motor drives the tray to move upward until the notes on the tray contact with the paper picking wheel again.

8. A self-service financial apparatus characterized by comprising the assembled note-issuing device according to claim 7.

9. A self-service financial apparatus characterized by comprising the assembled note-issuing device according to claim 6.

10. A self-service financial apparatus characterized by comprising the assembled note-issuing device according to claim 5.

11. A self-service financial apparatus characterized by comprising the assembled note-issuing device according to claim 4.

12. The assembled note-issuing device according to claim 1, characterized in that the printing assembly comprises a printing tray and a print head assembly installed on the printing tray; the print head assembly comprises a fixed plate, an elastic element, a floating plate configured with a print head, and a lifting mechanism; the floating plate comprises a top plate and a bottom plate, the top plate is located above the fixed plate while the bottom plate is located below the fixed plate; the elastic element is located between the fixed plate and the bottom plate in a compressed state as to provide downward pressure on the floating plate;

the lifting mechanism abuts against a lower surface of the top plate so that the floating plate can move up and down.

13. The assembled note-issuing device according to claim 12, characterized in that the lifting mechanism comprises a driving assembly, a cam power shaft and a cam; the driving assembly is fixed on an upper surface of the fixed plate, the driving assembly is coupled to one end of the cam power shaft and the cam is secured on the cam power shaft, the driving assembly drives the cam power shaft to rotate around an axis thereof so as to drive the cam to take circles around the cam power shaft.

14. A self-service financial apparatus characterized by comprising the assembled note-issuing device according to claim 13.

15. A self-service financial apparatus characterized by comprising the assembled note-issuing device according to claim 12.

16. A self-service financial apparatus characterized by comprising the assembled note-issuing device according to claim 1.

* * * * *